US006055709A

United States Patent [19]

Martek et al.

[11] Patent Number: 6,055,709

[45] Date of Patent: May 2, 2000

[54] METHOD OF DRY HEAT BULKING OF TUFTED PILE FABRIC

[75] Inventors: Craig M. Martek, Dillsburg; Keith Henry, Newville, both of Pa.

[73] Assignee: Lear Corporation, Southfield, Mich.

[21] Appl. No.: 09/238,792

[22] Filed: Jan. 28, 1999

Related U.S. Application Data

[60] Provisional application No. 60/073,183, Jan. 30, 1998.

[51] Int. Cl.[7] ..... D06C 7/00

[52] U.S. Cl. ..... 26/2 R; 28/159; 28/165

[58] Field of Search ..... 26/2 R, 2 E, 106; 28/159, 160, 161, 162, 165, 166, 167, 285, 286, 219, 247, 281; 57/290, 205; 34/385, 444, 445, 459

[56] References Cited

U.S. PATENT DOCUMENTS

| | | | |
|---|---|---|---|
| 1,917,555 | 7/1933 | Shuttleworth | 26/2 R |
| 3,015,223 | 1/1962 | Moore | 26/2 R |
| 3,362,087 | 1/1968 | Brock | 26/2 R |
| 3,872,558 | 3/1975 | Gomez et al. | 28/159 |
| 3,971,200 | 7/1976 | Richter | 57/34 HS |
| 4,189,336 | 2/1980 | Hutflesz | 28/159 |
| 4,301,577 | 11/1981 | Mueller et al. | 26/2 R |
| 4,578,132 | 3/1986 | Van Uden et al. | 28/159 |
| 4,617,208 | 10/1986 | Cadenhead, Sr. | 28/159 |
| 4,947,528 | 8/1990 | Dischler | 26/2 R |
| 5,099,553 | 3/1992 | Dischler | 26/2 R |
| 5,175,038 | 12/1992 | Tung et al. | 428/92 |
| 5,189,810 | 3/1993 | Vetter | 34/1.8 |
| 5,206,053 | 4/1993 | Calcaterra et al. | 427/373 |
| 5,533,364 | 7/1996 | Nakagawa | 26/2 R |
| 5,566,433 | 10/1996 | Love, III et al. | 26/2 R |

*Primary Examiner*—Amy B. Vanatta
*Attorney, Agent, or Firm*—Wood, Herron & Evans, L.L.P.

[57] ABSTRACT

A method of bulking tufted pile fabrics by means of the controlled application of dry heat thereto. The method of the present invention is particularly well suited to the continuous in-line bulking of carpet.

14 Claims, 2 Drawing Sheets

METHOD OF DRY HEAT BULKING OF TUFTED PILE FABRIC

This application claims the benefit of U.S. Provisional application Ser. No. 60/073,183 filed Jan. 30, 1998.

FIELD OF THE INVENTION

This invention relates to a method of bulking tufted pile fabrics by means of the controlled application of dry heat thereto. The method of the present invention is particularly well suited to the continuous in-line bulking of carpet to enhance the appearance and feel thereof.

BACKGROUND OF THE INVENTION

Quality in tufted pile fabrics, especially carpet, will depend, in part, on the amount of fibers per unit area contained in the pile. Generally, as the carpet fiber count per unit area increases, the attractiveness in both appearance and feel of the carpet increases. Carpet cost, however, also increases as the number of carpet fibers per unit area is increased. As a result, in order to enhance the appearance and feel of tufted pile fabrics, especially carpets, without increasing the number of fibers per unit area and the attendant costs of doing so, it is well known in the art to process such fabrics in order to increase the bulk of the constituent fibers which comprise the pile. The bulked pile resulting from such processing yields the plush appearance and hand of fabrics having greater fiber counts per unit area. As used herein, fiber bulk will refer to the density of fibers per unit volume rather than the fiber count per unit area, and bulking will refer generally to processes which are designed to increase the bulk of fibers.

The methods of bulking tufted pile fabrics known to the art have generally employed steam and the use of beater elements, or alternatively, the application of polymer compositions to the fibers. As described in U.S. Pat. No. 4,301,577—Mueller et al., tufted pile fabrics which have been bent, matted or crushed during processing can be bulked by heating the fabric in a steam chamber by means of the application of steam forced through the backing material and out the face of the fabric, combined with the application of multiple bar beaters to the back side of the fabric. (Mueller et al. col. 2, lines 21–39). The use of steam in such processes, however, presents difficulties as the methods employed to deliver the steam produce variations in the quality and quantity of the steam so applied. These fluctuations lead to an undesirable inconsistency in the degree of fiber bulk thus achieved. Moreover, the resulting article may exhibit an insufficient degree of added bulkiness to justify the use of such processes. The additional bulk imparted to the end product by such methods is often minimal compared to the significant cost of the additional machinery and processing time necessary in the utilization of these methods.

As described in U.S. Pat. No. 5,206,053—Calcaterra, et al., fiber bulk can be enhanced by application of an aqueous solution, emulsion or foam formulation containing a terpolymer comprising phenyl vinyl ether, 2-(4-hydroxymethylphenyl)ethyl vinyl ether and maleic anhydride, or compositions of two copolymers prepared from specific combinations of such monomers. This process, however, is undesirable as the use of polymers or polymeric compositions, whether as solutions, emulsions, foam formulations or otherwise, requires additional processing time and imposes additional costs for materials and chemical expertise, as well as the burdens of various treatment, storage and disposal requirements which may be imposed by applicable environmental regulations.

Applicants have surprisingly and unexpectedly found that the controlled application of dry heat to tufted pile fabric, such as carpet, can increase the fiber bulk thereof uniformly and inexpensively thereby enhancing its appearance and feel to that of more expensive tufted pile fabrics having greater fiber counts per unit area.

It is therefore an object of the present invention to provide a method of bulking tufted pile fabric by means of the controlled application of dry heat.

It is another object of the present invention to provide a method of bulking carpet, and even more preferably solution-dyed tufted carpet, by means of the controlled application of dry heat.

It is still another object of the present invention to provide a method of in-line bulking of tufted pile fabric by means of the controlled application of dry heat.

It is yet another object of the present invention to provide a method of in-line bulking of carpet, and even more preferably solution-dyed tufted carpet, by means of the controlled application of dry heat.

SUMMARY OF THE INVENTION

The present invention relates to a method of bulking tufted pile fabric by means of the controlled application of dry heat. In certain embodiments, this method is used in the bulking of carpet to enhance both its appearance and feel without any increase in fiber count. In certain preferred embodiments, this method is employed as a part of the overall carpet manufacturing process.

The method of the present invention comprises the steps of exposing tufted pile fabric, and preferably tufted pile carpet, to preselected elevated temperature conditions in an environment substantially free of moisture for a time sufficient to bulk the pile fabric, and then allowing the bulked tufted pile fabric to cool. In certain preferred embodiments, the tufted pile fabric is carpet which may be solution dyed prior to bulking. In more preferred embodiments, the steps of the present invention are performed as a part of the manufacture of the carpet.

DETAILED DESCRIPTION OF PREFERRED EMBODIMENTS

Figure 1:
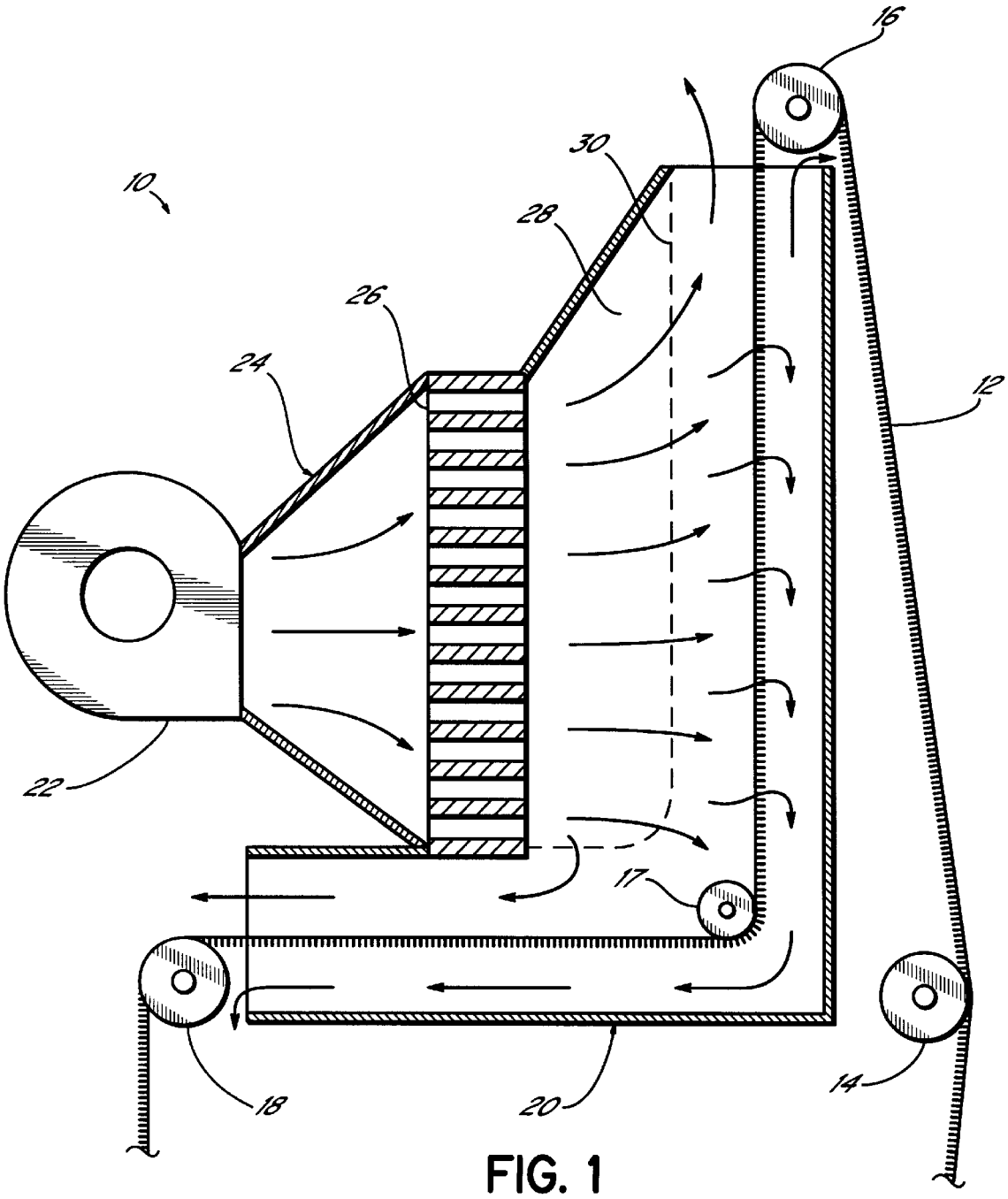
FIG. 1 is a schematic view of an apparatus for performing certain preferred embodiments of the invention.

As disclosed herein, the method of the present invention provides an inexpensive and efficient way to increase the bulk of tufted pile fabric without any increase in fiber count per unit area. More specifically, by use of the method disclosed herein, the bulk of tufted pile fabric, such as carpet, can be increased by means of the controlled application of dry heat, preferably as a part of the overall manufacturing process.

The present invention preferably comprises exposing tufted pile fabric to a temperature of at least about 250° F., and more preferably between about 270° F. and about 300°

F., for a period of about 45 seconds to about one minute. It will be understood, however, that the combination of temperature and time of exposure will vary according to a variety of factors including but not limited to the composition, fiber density, and initial pile height of the tufted pile fabric and, if part of a continuous, in-line manufacturing process, the speed of the line and the length of the portion of the line to which heat is applied.

An important and critical aspect of the preferred embodiments of the present invention resides in exposing the tufted pile fabric to the aforementioned time and temperature conditions in the substantial absence of added moisture. Applicants have surprisingly found that the presence of substantial amounts of added moisture to the environment during the temperature maintaining step has a significant detrimental impact on the bulking sought to be achieved. Accordingly, the preferred embodiments of the present invention required the use of "dry heat." As used herein, the term "dry heat" refers to exposing the pile fabric to conditions capable of maintaining the fabric within the desired temperature range and for the desired period of time in the substantial absence of added moisture.

As those skilled in the art will appreciate from the disclosure contained herein, several techniques for maintaining relatively high temperatures are known in the art and are adaptable for use in accordance with this aspect of the invention. For example, the desired dry heat temperatures can be achieved by means of a convection oven in which the convection gases do not contain added moisture. Thus it is contemplated that direct fired and indirect fired convection ovens may be used. However, it will be appreciated that the use of the direct application of steam to raise the temperature of the fabrics to within the desired range will not be within the scope of the present invention because such a process would expose the fibers to undesirable moisture conditions. In addition to direct and indirect convection heating, it is also contemplated that radiant heating sources may be used to expose the pile fabrics to the temperature parameters required herein in the substantial absence of added moisture.

In certain preferred embodiments, the first step of the present invention is performed as a continuous, in-line process as a part of the overall manufacture of the fabric. In typical and conventional processes for the manufacture of tufted pile carpet, the continuous length or web of carpet, which may be dyed or printed, is produced. According to the present invention, this web is treated, preferably as part of the manufacturing process, so as to produce the time and temperature conditions described hereinbefore. An apparatus for achieving this result is illustrated schematically in FIG. 1. In such embodiment, the continuous length or web of tufted pile carpet is introduced into a bulking oven adapted to expose the fabric to a temperature within the desired range of temperatures and for a time within the desired range of time periods. As will be appreciated by those skilled in the art, the speed of the fabric through the heated portion of the line will vary as a function of numerous factors, including the length of the heated portion of the line through which the fabric passes, the type and character of the heat source, and the composition and construction of the fabric. More specifically, and by way of example, as the speed of the fabric through the heated portion of the line increases, the length of the heated portion of the line through which the fabric passes must also increase so that the desired exposure time for the selected temperature is maintained. Conversely, as the speed of the fabric through the heated portion of the line is decreased, the length of the heated portion of the line through which the fabric passes must similarly be decreased to maintain the net exposure time for any given region of the fabric.

According to preferred embodiments of the present invention, the heat is supplied to the fabric via a convection oven in which the convection gases are at a temperature of about 250° to about 300° F., and even more preferably from about 260° to about 280° F., wherein such oven is sized to result in a fiber residence time of about 45 seconds to about 75 seconds, and even more preferably about 60 seconds. In certain preferred embodiments in which a convection oven is used for carpets having a width of about eight feet, the air flow will be at least about 100 cubic feet per minute (cfm), and preferably about 600 to about 1500 cfm.

While the precise mechanism causing the fibers to bulk is not fully understood by the applicants, experiments have shown that temperature is an important factor in effecting sufficient bulking. If the temperature of the convection gases are significantly above 300° F., the integrity of the fibers may become degraded or even destroyed. Further, while there is no noticeable detriment to the fibers if the exposure time of the fabric to the dry heat significantly exceeds about 75 seconds, little additional bulking is realized. If, however, the temperature of the convection gases are significantly below 250° F., or if the exposure time is significantly less than 45 seconds, inadequate bulking results and the benefits to the appearance and feel of the fabric are not sufficiently realized. In those embodiments in which a convection oven is used, it has been found that the rate of the air flow into the oven or through the fabric, to the extent permitted by the porosity of the fabric, is not critical. The air flow can be relatively low and still provide the desired effect.

As those skilled in the art will appreciate, several techniques for cooling the bulked fabric are known in the art and are adaptable for use in accordance with this aspect of the invention. In certain preferred embodiments, the next step in the methods of the present invention comprises allowing the heated fabric to cool by ambient cooling. In other preferred embodiments, the cooling step is accomplished by means of the application of forced air. Preferably, the cooling step will occur as a part of the overall manufacturing process and, more preferably, immediately prior to "roll up," the step in which continuous lengths of tufted pile fabric are formed into rolls. Depending on the cooling properties of the fabric and the greater environment in which the cooling step occurs, the cooling step may take place entirely prior to roll up or at least partly prior to roll up of the fabric. For the purposes of practicing the invention it is important only that the fabric is sufficiently cooled prior to roll up so as to prevent pile crushing defects which might otherwise be caused thereby.

In certain preferred embodiments, the step of exposing tufted pile fabric to heat is preceded by conveying the tufted pile fabric into the area where heat is applied, such as an oven. This additional step can be accomplished in a variety of ways well known to the art, such as the use of conveyor belts and/or rollers. Preferably, this step occurs as a part of the overall manufacturing process and, more preferably, following the tufting of the fabric.

In certain preferred embodiments, the step of exposing tufted pile fabric to heat is followed by conveying the tufted pile fabric out of the area where heat is applied, such as an oven, and precedes roll-up. This step can also be accomplished in a variety of ways well known to the art, such as the use of conveyor belts and/or rollers. Preferably, this step occurs as a part of the overall manufacturing process.

The resulting bulked tufted pile fabric can then be used as an effective substitute for more expensive tufted pile fabrics having greater fiber counts per unit area as the methods disclosed herein permit such fabric to have an appearance and feel similar to those of higher fiber count fabrics.

DETAILED DESCRIPTION OF FIG. 1

The present invention may be more fully understood when described in reference to FIG. 1, a schematic view of an apparatus which may be used in practicing certain preferred embodiments of the present invention. The embodiments shown in FIG. 1 should be considered as showing merely certain examples of the methods of the present invention and should not be viewed as limiting in any respect the full scope of the invention as disclosed herein.

As shown generally at 10, a continuous web of tufted pile fabric 12 is threaded over guide roller 14 so that the tufted face of the fabric comes in contact with guide roller 14. As the fabric is advanced, is then threaded around guide roller 16 and into the oven enclosure 20. As shown, the oven enclosure 20 is arranged in an L shape, but other arrangements which permit adequate exposure of the fabric to the heated air should be considered within the scope of the invention. The fabric 12 is guided through the oven enclosure 20, around internal guide roller 17 and then out of the oven enclosure 20 to guide roller 18. Upon leaving the oven enclosure 20, the cooling step can begin as the fabric 12 is advanced to roll up (not shown).

In addition to the oven enclosure 20, the convection oven comprises one or more blowers 22 which generate a flow of air. During the operation of the apparatus, the air flow generated by the blowers 22 is directed through an air plenum 24 to a heat transfer unit 26. The heat transfer unit 26 may effect heat transfer to the air flow by means of steam coils, electricity or any other means well known to those skilled in the art, and their use should be considered within the scope of the invention. The heated air then travels through a second air plenum 28 which directs the air though a perforated metal sheet 30 into the oven enclosure 20 containing fabric 12. It should be understood that a mesh screen, baffles or any other suitable means for evenly distributing the heated air into the oven enclosure 20 may be used and are within the scope of the invention. The heated air then flows through the oven enclosure 20, at least partially through fabric 12, and then exits the oven enclosure 20 at either end thereof. The percentage of the total air flow that flows through fabric 12 will depend on, among other things, the rate of the air flow generated by the blowers 22 and the porosity of fabric 12. Further, the temperature is controlled by means of a thermocouple located in the second air plenum 28 and connected to the heat transfer unit 26.

EXAMPLE 1

In this example, a tufted pile carpet sample in which the constituent tufts comprise 1000 denier fibers arranged in a double horseshoe configuration was bulked by means of the method of the present invention. The carpet, supplied in eight foot wide rolls, was continuously fed by means of rollers through a convection oven which was set for an air flow of 1200 cfm with the temperature of the forced air set for 300° F. The oven used in this Example had an internal length of 8 feet, and the line speed of the carpet was set for 8 feet per minute. As a result, the residence time of the carpet in the oven was approximately 60 seconds. After heating, the carpet was allowed to cool by ambient cooling and was rolled up prior to completion of the cooling step.

Figure 2:
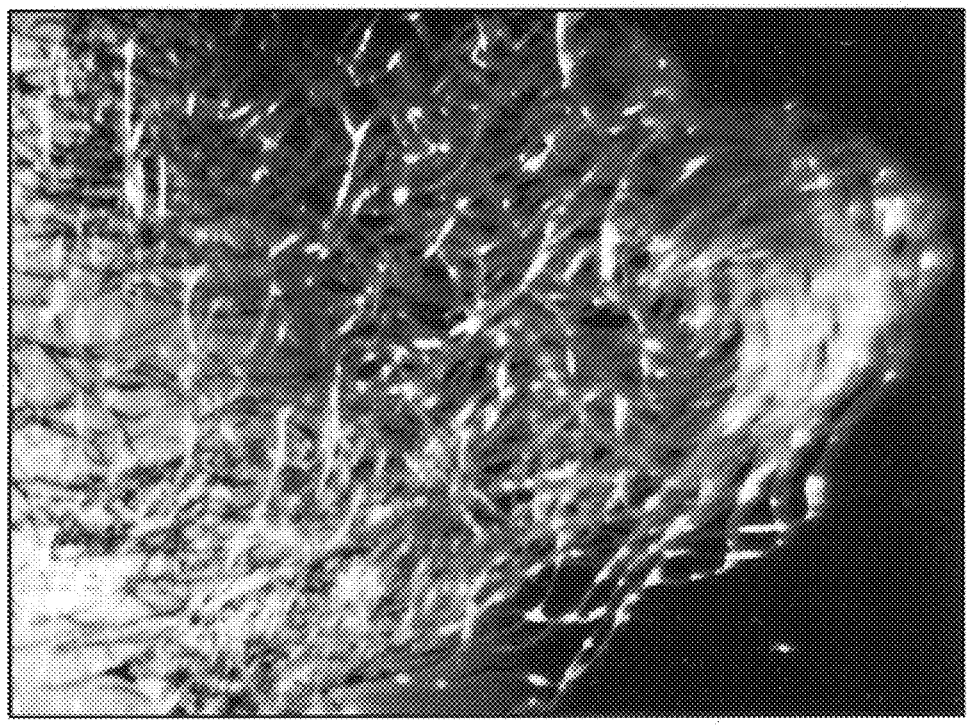
FIG. 2 is a photograph of a tuft from a tufted pile carpet sample which has been bulked in accordance with the methods of the present invention.
Figure 3:
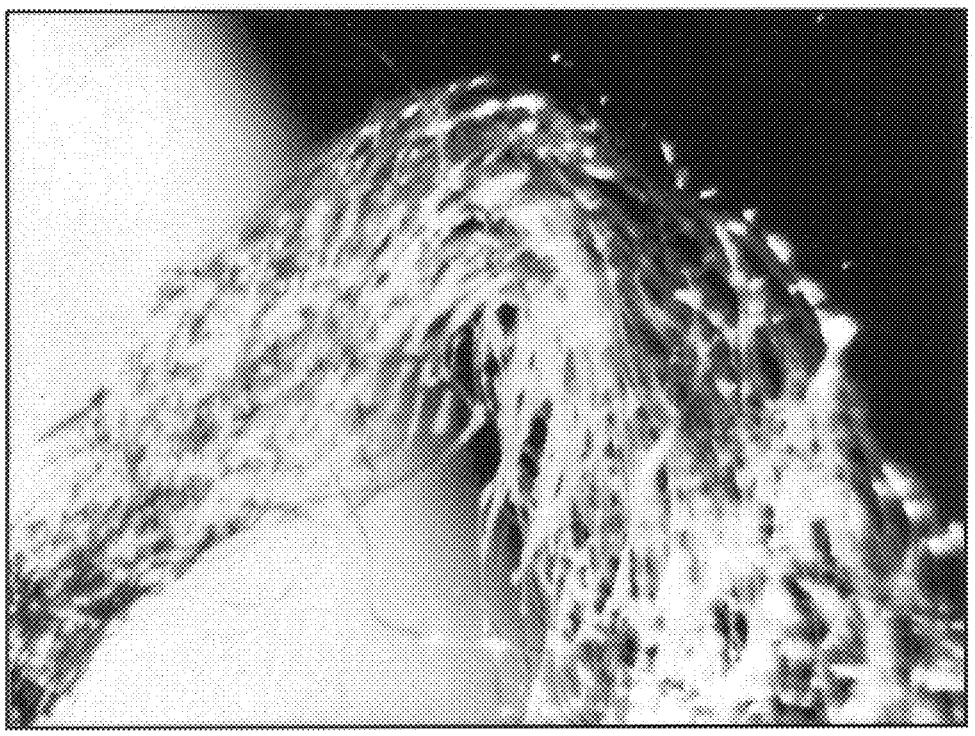
FIG. 3 is a photograph of a tuft from the tufted pile carpet sample shown in FIG. 2 prior to bulking.

After bulking, the tufted pile carpet as shown in FIG. 2 had a uniformly plush appearance markedly improved over the unbulked sample as shown in FIG. 3. This increase in fiber bulk made the carpet display the appearance and feel of much denser carpet but without any increase in fibers per unit area.

COMPARATIVE EXAMPLE 1

In this comparative example, a carpet sample identical to the sample used in Example 1 was bulked by means of the method set forth in Mueller et al. The sample was then visually and tactually compared with the sample used in Example 1. It was observed that the Example 1 sample was more uniformly bulked and had superior hand and appearance compared to sample bulked by means of the method set forth in Mueller et al.

What is claimed is:

1. A method of bulking tufted pile fabric comprising the steps of:

a. exposing the tufted pile fabric to preselected elevated temperature conditions in an environment substantially free of added moisture for a time sufficient to bulk the pile fabric; and b. allowing the tufted pile fabric to cool.

2. The method of claim 1 wherein the preselected temperature conditions are from about 250° F. to about 300° F. and the time of exposure is about one minute.

3. The method of claim 2 wherein the tufted pile fabric is carpet.

4. The method of claim 3 wherein the carpet is solution dyed prior to bulking.

5. The method of claim 1 wherein the tufted pile fabric is carpet.

6. The method of claim 5 wherein the carpet is solution dyed prior to bulking.

7. The method of claim 3 wherein the method comprises a series of steps within a manufacturing process of the carpet wherein the method begins after a tufting step in the manufacturing process and before a roll up step in the manufacturing process.

8. The method of claim 7 wherein the carpet is solution dyed prior to bulking.

9. A method of bulking tufted pile fabric comprising the steps of:

a. conveying the tufted pile fabric into a dry heat bulking oven;

b. exposing the tufted pile fabric in said dry heat bulking oven to dry heat for a time sufficient to bulk the pile fabric;

c. conveying the tufted pile fabric out of the dry heat bulking oven; and d. allowing the tufted pile fabric to cool.

10. The method of claim 9 wherein said exposing step comprises exposing the tufted pile fabric to temperatures from about 250° F. to about 300° F. for about one minute.

11. The method of claim 10 wherein the tufted pile fabric is carpet.

12. The method of claim 11 wherein the carpet is solution dyed prior to bulking.

13. The method of claim 9 wherein the tufted pile fabric is carpet.

14. The method of claim 13 wherein the carpet is solution dyed prior to bulking.

* * * * *